US006098323A

United States Patent [19]

McGuiness

[11] Patent Number: 6,098,323

[45] Date of Patent: Aug. 8, 2000

[54] SPORTS TRADING CARD

[76] Inventor: Robert G. McGuiness, 637 Humbolt St., Eureka, Calif. 95501

[21] Appl. No.: 09/301,447

[22] Filed: Apr. 29, 1999

[51] Int. Cl.[7] ..... G09F 1/00; A63H 33/38

[52] U.S. Cl. ..... 40/124.191; 40/594; 446/147; 446/149

[58] Field of Search ..... 40/124.191, 594, 40/FOR 100; 446/901, 147, 149

[56] References Cited

U.S. PATENT DOCUMENTS

| | | | |
|---|---|---|---|
| 4,652,239 | 3/1987 | Brimberg . | |
| 5,102,171 | 4/1992 | Saetre | 40/124.191 X |
| 5,258,214 | 11/1993 | Coolege et al. . | |
| 5,270,101 | 12/1993 | Helicher | 428/209 |
| 5,390,933 | 2/1995 | Kraus . | |
| 5,417,431 | 5/1995 | Gluck | 40/124.191 X |
| 5,421,583 | 6/1995 | Gluck | 40/594 X |
| 5,520,985 | 5/1996 | Helicher | 40/124.191 X |
| 5,688,346 | 11/1997 | Corbusier . | |
| 5,893,229 | 4/1999 | Werner | 40/594 X |
| 5,914,158 | 6/1999 | McGuiness | 428/13 |
| 5,916,650 | 6/1999 | Rosenbaum et al. | 428/40.1 |
| 5,970,638 | 10/1999 | Henley | 40/594 |

*Primary Examiner*—Terry Lee Melius
*Assistant Examiner*—Rodrigo J. Morales
*Attorney, Agent, or Firm*—Patent & Trademark Services; Joseph H. McGlynn

[57] ABSTRACT

A sports trading card that has a picture of an athlete on one side and statistics for the athlete on a reverse side. The picture and the statistics are imprinted on layers or cover sheets that are secured to opposite sides of a backing surface by means of static cling.

6 Claims, 1 Drawing Sheet

| YEAR | G | AB | R | H | HR | RBI | BB | SC | AVG |
|---|---|---|---|---|---|---|---|---|---|
| 98 | 160 | 650 | 130 | 110 | 70 | 140 | 150 | 100 | 296 |

SPORTS TRADING CARD

BACKGROUND OF THE INVENTION

This invention relates, in general, to trading cards, and, in particular, to sports trading cards that have removable portions.

DESCRIPTION OF THE PRIOR ART

In the prior art various types of cards have been proposed. For example, U.S. Pat. No. 4,652,239 to Brimberg discloses a space planning system which has elements representing shapes of furniture which can be attached to a substrate by means of static cling.

U.S. Pat. No. 5,258,214 to Cooledge et al discloses a wall covering having an image printed thereon and which can be removed and attached to various vertical surfaces by static cling.

U.S. Pat. No. 5,390,933 to Kraus discloses a baseball game with pictures of sports figures.

U.S. Pat. No. 5,688,346 to Corbusier discloses a sticker similar to a bumper sticker which has a picture of a football player thereon.

SUMMARY OF THE INVENTION

The present invention is directed to a sports trading card that has a picture of an athlete on one side and statistics for the athlete on a reverse side. The picture and the statistics are secured to layers on opposite sides of the card by means of static cling.

It is an object of the present invention to provide a new and improved trading card.

It is an object of the present invention to provide a new and improved trading card that has a picture of an athlete on one side that can be removed and adhered to a vertical surface by static cling.

It is an object of the present invention to provide a new and improved trading card in which portions of the card can be removed and adhered to different surfaces to serve as decorations.

These and other objects and advantages of the present invention will be fully apparent from the following description, when taken in connection with the annexed drawings.

DESCRIPTION OF THE PREFERRED EMBODIMENT

Figure 1:
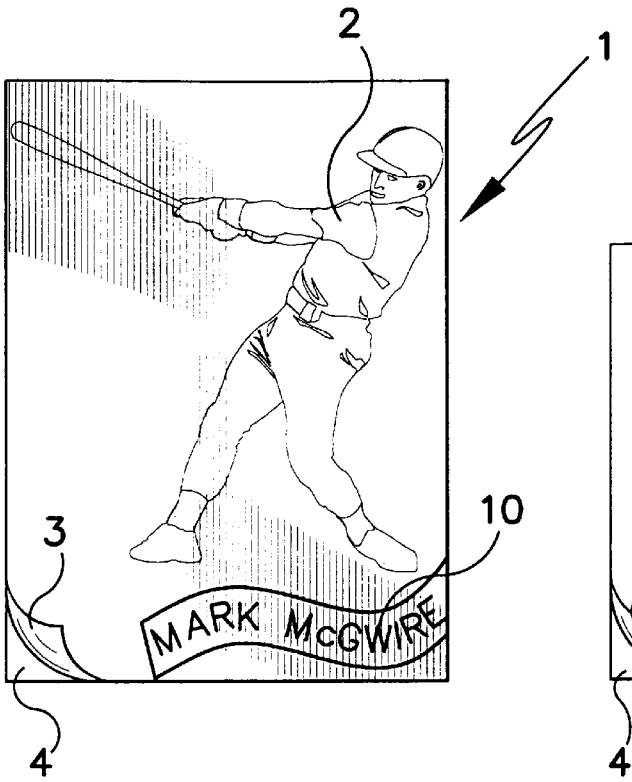
FIG. 1 is front view of one type of trading card embodying the concepts of the present invention.

Referring now to the drawings in greater detail, FIG. 1 shows a front view of one type of trading card 1. The card is a typical baseball trading card having a picture of a baseball player 2 imprinted thereon. In addition, the player's name 10 will be placed on the front of the card in a strategic location. As shown in FIG. 1 the player's picture and name will be imprinted onto a flexible layer or cover sheet 3. The flexible layer 3 in FIG. 1 is peeled back at the lower left corner to expose the backing surface 4.

The backing surface can be made from any type of material such as, but not limited to, cardboard, that is strong enough and durable enough to support the layer 3. The layer 3 is secured to the surface 4 without any type of adhesives so the layer 3 is easily removable from the backing surface 4.

The layer 3 can be made from a material such as, but not limited to, vinyl which is a strong, flexible material and is adhered to the backing surface by means of static cling, similar to the manner that the symbols 41 and 43 of Brimberg (U.S. Pat. No. 4,652,239) are secured to the backing 20. The Brimberg reference is hereby incorporated by reference into the present application.

Since the layer 3 is secured to the backing surface 4 only by means of static cling, it will be relatively easy to remove the layer 3 from backing 4 without damaging the layer 3 or backing 4. Layer 3 can then be applied to virtually any relatively smooth surface such as a wall or door. In this manner, the owner of the card can leave the layer on the backing surface and use it in the normal way that all trading cards are used, or he can remove layer 3 and apply it to his walls, doors or other surfaces. In this case, the layer 3 will serve as a decoration which will not damage the surface it is applied to, and can be easily removed and quickly applied to another surface.

Figure 2:
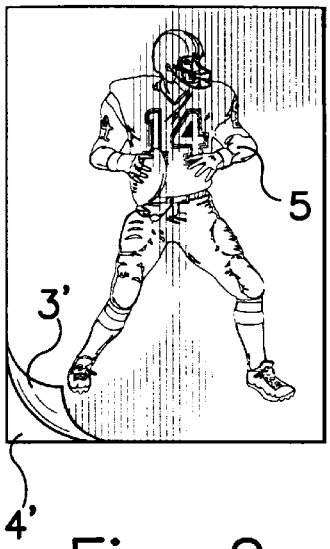
FIG. 2 is a front view of another type of trading card embodying the concepts of the present invention.

FIG. 2 shows the front of a trading card from a different sport. In this case the sport is football and the card has a picture of a football player 5 imprinted on the layer or cover sheet 3' similar to the way the FIG. 2 is applied to the layer 3 in FIG. 1. The layer 3' is attached to the backing surface 4' by means of static cling. Obviously, the particular type of sport that the trading cards of the present invention depict are not critical to the invention, and any sport can be represented by the trading cards, such as baseball, football, soccer, etc.

Figure 3:
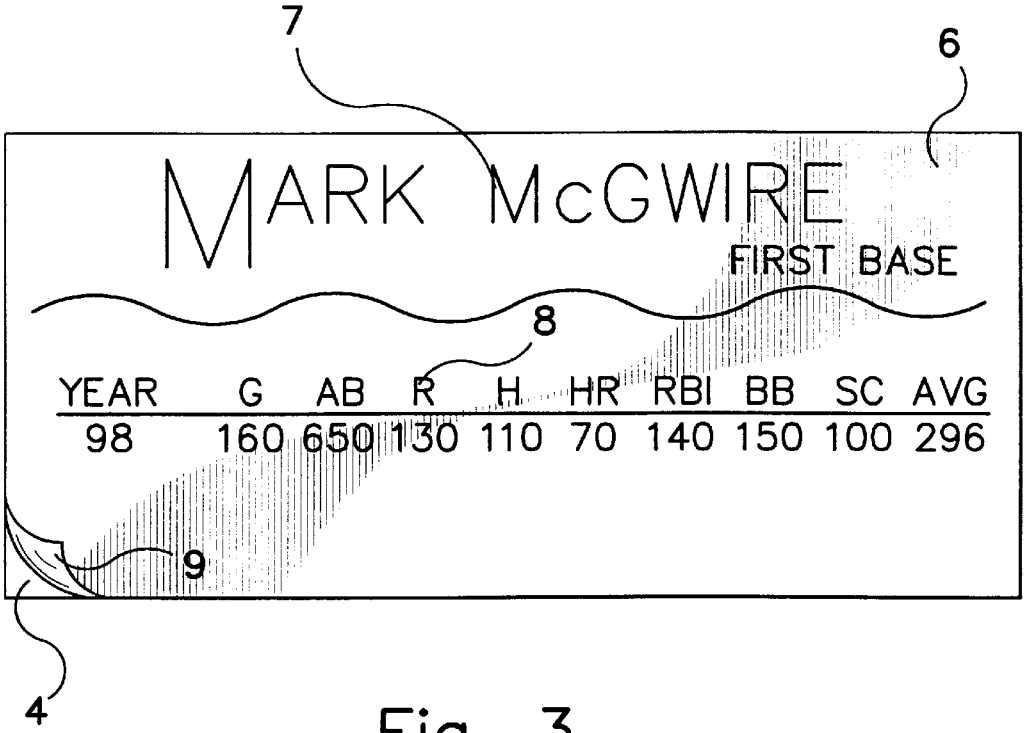
FIG. 3 is a back view of the FIG. 1 type of trading card of the present invention.

FIG. 3 shows the back of the trading card depicted in FIG. 1. The back of the trading card 1, again, has a layer or cover sheet 9 similar to the layer 3 which is secured to the backing 4 by static cling. The layer 9 will have information such as the player's name 7 and his playing statistics 8 imprinted thereon by any conventional method. Again, the layer 9 can be easily removed from the surface 4 without damage to either the surface or the layer, and the layer 9 call be secured to an other surface, other than the surface 4.

It should be noted that the statistics shown in FIG. 3 are merely for illustrational purposes and are not to be construed as the only manner in which the statistics can be displayed, or the only statistics that can be used on the back of the trading cards. In addition, the type of statistics used on the back of the card will reflect the type of sports figure displayed on the front of the card. That is, a baseball player will have baseball statistics on the back and a football player will have football statistics on the back.

Although the Sports Trading Card and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A trading card comprising:

a backing surface, said backing surface having a front surface and a rear surface, a first cover sheet secured to said front surface only by means of static cling, a second cover sheet secured to said rear surface only by means of static cling, said first cover sheet having a picture of a player affixed thereto, said second cover sheet having statistics, related to said player, affixed thereto, whereby said first and second cover sheets can be easily removed from said front surface and said rear surface of said backing surface and removably secured to another surface.

2. The trading card as claimed in claim 1, wherein said player is a baseball player.

3. The trading card as claimed in claim 1, wherein said player is a football player.

4. The trading card as claimed in claim 1, wherein said player is a sports figure.

5. The trading card as claimed in claim 1, wherein said first cover sheet is a single piece which covers the entire front surface of said backing surface.

6. The trading card as claimed in claim 1, wherein said second cover sheet is a single piece which covers the entire rear surface of said backing surface.

* * * * *